US006949739B2

(12) United States Patent
Franzen

(10) Patent No.: US 6,949,739 B2
(45) Date of Patent: Sep. 27, 2005

(54) IONIZATION AT ATMOSPHERIC PRESSURE FOR MASS SPECTROMETRIC ANALYSES

(75) Inventor: Jochen Franzen, Bremen (DE)

(73) Assignee: Brunker Daltonik GmbH, Bremen (DE)

( * ) Notice: Subject to any disclaimer, the term of this patent is extended or adjusted under 35 U.S.C. 154(b) by 0 days.

(21) Appl. No.: 10/624,913

(22) Filed: Jul. 22, 2003

(65) Prior Publication Data

US 2004/0129876 A1 Jul. 8, 2004

(30) Foreign Application Priority Data

Aug. 8, 2002 (DE) ..... 102 36 344

(51) Int. Cl.[7] ..... H01J 49/00

(52) U.S. Cl. ..... 250/288; 250/283; 250/287; 250/281

(58) Field of Search ..... 250/288, 283, 250/287, 281

(56) References Cited

U.S. PATENT DOCUMENTS

| | | | | |
|---|---|---|---|---|
| 4,712,008 A | * | 12/1987 | Vora et al. | 250/287 |
| 4,855,595 A | * | 8/1989 | Blanchard | 250/287 |
| 5,663,561 A | | 9/1997 | Franzen et al. | |
| 5,736,740 A | | 4/1998 | Franzen | |
| 5,750,988 A | | 5/1998 | Apffel et al. | |
| 5,818,041 A | | 10/1998 | Mordehai et al. | |
| 5,877,495 A | | 3/1999 | Takada et al. | |
| 5,965,884 A | * | 10/1999 | Laiko et al. | 250/288 |
| 6,121,608 A | | 9/2000 | Takada et al. | |
| 6,177,669 B1 | | 1/2001 | Wells et al. | |
| 6,239,428 B1 | * | 5/2001 | Kunz | 250/287 |
| 6,586,732 B2 | * | 7/2003 | Lee et al. | 250/288 |
| 2002/0175278 A1 | * | 11/2002 | Whitehouse | 250/281 |
| 2003/0089849 A1 | * | 5/2003 | Guevremont et al. | 250/287 |
| 2004/0094702 A1 | * | 5/2004 | Clemmer | 250/283 |

FOREIGN PATENT DOCUMENTS

| | | |
|---|---|---|
| DE | 195 20 276 A1 | 6/1995 |
| DE | 196 08 963 A1 | 3/1996 |
| DE | 100 42 394 A1 | 8/2000 |
| DE | 100 44 655 A1 | 9/2000 |
| EP | 0 762 473 A3 | 9/1996 |
| GB | 2 299 445 A | 10/1996 |
| WO | WO 00/52735 A1 | 9/2000 |
| WO | WO 02/097854 A2 | 12/2002 |

* cited by examiner

*Primary Examiner*—Nikita Wells
*Assistant Examiner*—James J. Leybourne

(57) ABSTRACT

The invention relates to the feeding of analyte ions, generated at atmospheric pressure, efficiently into the mass spectrometer. The invention provides a lengthy ion mobility drift tube with a focusing electric field inside to guide the ions from an ionization cloud generated at atmospheric pressure towards the entrance opening of the mass spectrometer, and to dry droplets which might occur in the ionization cloud by a hot drying gas flowing through the ion mobility drift tube towards the ionization cloud.

35 Claims, 2 Drawing Sheets

IONIZATION AT ATMOSPHERIC PRESSURE FOR MASS SPECTROMETRIC ANALYSES

FIELD OF INVENTION

The invention relates to the feeding of analyte ions, generated at atmospheric pressure, efficiently into a mass spectrometer.

BACKGROUND OF THE INVENTION

During the last 10 to 15 years, two ionization methods have become generally accepted in the mass spectrometric analysis of biochemical polymers in proteomics, genomics or metabolomics (the examination and measurement of metabolic processes) among other areas. These methods are matrix-assisted laser desorption and ionization (MALDI), which is predominantly used for solid samples prepared on sample support plates, and electrospray ionization (ESI), which is used under atmospheric pressure on samples in solution. The electrospray method can be coupled relatively easily to separation methods for mixed components such as high-performance liquid chromatography (HPLC) or capillary electrophoresis (CE). Laser desorption, which was previously only used under vacuum, can now also be used at atmospheric pressure, making it easier to introduce the sample. MALDI is characterized by a high sample throughput through the mass spectrometer. The analyte substances, however, must be separated, preferably by a separation method which is performed upstream.

In the meantime, a whole family of ionization methods operating at atmospheric pressure has been developed. These are covered by the abbreviation API (atmospheric pressure ionization). In addition to the electrospray method used originally, there is now a pneumatic method of spraying through concentric capillaries, which is coupled to photoionization by means of UV radiation with sufficient energy (APPI=atmospheric pressure photoionization) or coupled to a method using chemical ionization by primary ions generated by corona discharge (APCI=atmospheric pressure chemical ionization). Also included is the matrix-assisted laser desorption and ionization method at atmospheric pressure (AP MALDI) previously mentioned, where is no spraying process is involved.

All ionization methods at atmospheric pressure are characterized by the formation of an ionization cloud, which can be moved with the surrounding gas. This cloud may already contain some or all of the analyte ions or else these analyte ions may be produced by intermediate processes (such as chemical ionization, droplet drying or photoionization) after the cloud has formed. For all these methods, as many of the ions as possible must be guided from this cloud, which varies in size, to the entrance of the mass spectrometer and transferred to its vacuum system.

With the original electrospray method, a voltage of several kilovolts was applied across the end of a metal spray capillary and a counter electrode which were approximately 20 to 50 mm apart.

A polarizable liquid inside the capillary (usually water but sometimes water mixed with an organic solvent such as methanol or acetonitrile) is dielectrically polarized by the electric field at the end of the spray capillary and drawn out to form a cone, the so-called Taylor cone. At the end of this cone, the surface tension of the liquid is no longer able to resist the pulling force of the electric field, which is concentrated at this point. This causes a tiny beam of liquid to be torn off. The tiny beam of liquid breaks immediately into a spray cloud of tiny drops, which are electrically charged because the surface of the liquid is dielectrically polarized. With positive drops, the electric charge arises from protons produced by the dissociation of the spray fluid. (As is known, water is dissociated under normal conditions, pH 7, into $H^+$ and $OH^-$ ions at $10^{-7}$ parts).

Initially, the charged droplets are rapidly accelerated from the tip by the non-homogeneous electric field but rapidly decelerated in the surrounding gas. This is a drying gas which usually consists of heated nitrogen. Here, the spray cloud appears as an ionization cloud with relatively clearly defined borders. This cloud drifts with the movement of the gas; the charged particles can be pulled out of the cloud by external electric fields.

In the hot drying gas, into which the charged particles are pulled, liquid evaporates from the droplets. It has to be assumed that it is the organic solvent which evaporates first. As the diameters of the now aqueous droplets decrease, their vapor pressure increases since the so-called coordination number of the molecules decreases at the surface. The coordination number gives the number of immediate neighbors, which determines how the surface molecules are bonded to the droplets. This determines the vapor pressure. However, if the liquid evaporates rapidly there is a danger that the droplets will freeze due to the loss of heat from evaporation so further drying will be slowed down.

If the droplets are highly charged, then the charges are driven to the surface by coulombic repulsion. With charged particles, the mutual repulsion increases the vapor pressure so that molecules such as protonated water ($H_3O^+$) are driven out. Theoretical considerations have shown that this causes the smaller particles to be 'pinched off' and then separated. All of these processes are greatly impeded or prevent altogether by the droplets freezing.

If there are some larger molecules in the droplet which usually can be easier charged by protonation (because of their higher proton affinity) than the molecules of the liquid (or by deprotonation if the polarity of spray voltage is reversed), then the larger molecules regularly will remain ionized after the liquid has fully evaporated. At the same time, the ionized molecules continue to migrate towards the counter electrode or towards other electrodes in their vicinity due to the electric field, by the known process of 'ion mobility'. They can then be guided according to the shape of the electric fields and the surrounding gas flow and finally transferred to the vacuum system of a mass spectrometer through a fine aperture in the wall or through a transfer capillary.

In the electrospray ion sources which have been commercially available until now, the spray cloud is located only three to five centimeters from the entrance of the electrically attractive tip of a transfer capillary. The capillary transfers the ions, enveloped in neutral gas, into the vacuum of the mass spectrometer. Because of the short distance, not all of the droplets are completely dried. Some droplets which are not dried are pulled into the transfer capillary and, therefore, into the vacuum, while others are deposited around the entrance of the transfer capillary.

The droplets are detached from the Taylor cone at the tip of the spray capillary or from the fine liquid beam at the extremely fast rate of $10^5$ to $10^8$ droplets per second, depending on the supply of liquid in the capillary, so the result is usually a continuous ion beam. The supply is maintained by a very smoothly operating pump, usually a spray pump. The pumps of liquid chromatographs can be used for this purpose.

The larger molecules are usually charged not just singly but multiply during this process. The larger the molecule, the greater the average charge number, although there is regularly a wide distribution of charge numbers. As a rule of thumb, the average charge number increases by about one unit of charge per 1000 to 1500 atomic mass units. However, the charge also largely depends on the fold structure of the biopolymers. Large, denatured (unfolded) biomolecular ions with masses amounting to several ten thousands of atomic mass units can certainly carry 10 to 50 charges. In the case of peptides with five to twenty amino acids (mass range from approximately 600 to 2400 atomic mass units), most ions carry two charges and the distribution in this case ranges from singly charged ions to ions with 5 charges. The charge is usually protonation, not ionization by electron loss; in other words, it is produced by the bonding of charged hydrogen atoms $H^+$. For this reason, the ionization greatly depends on the hydrogen-ion concentration (i.e., the pH value) of the sprayed solution.

With electrospray ion sources using metal spray capillaries, the droplets initially have a self-establishing diameter of a half to two micrometers depending on the dielectric constant, pH, viscosity, conductivity, flow rate and surface tension of the liquid. Occasionally, larger droplets are also produced. Electrospray ionization is not always stable, and sometimes there are floating states which lead to irregular droplet formation and a strongly fluctuating ion beam. With liquid flows in the range of one microliter per minute, supplying a spray gas coaxially has usually been found to be a successful method of stabilizing the spraying process ("gas-supported spraying"). All commercially manufactured electrospray ion sources operate today with gas-supported spraying (see, for example, A. C. Hirabayashi and Y. K. Hirabayashi, EP 0762 473 A2 or J. L. Bertsch et al. WO 97/28 556 AI). The spray gas which is supplied has a major effect on the shape of the ionization cloud, which has an increased circumference and length.

A stable operating mode is also dependent on the properties of the spray liquid mentioned above. Frequently, a stable spray is only possible within a relatively narrow range of these parameters. For this reason, supplying a supplementary liquid, which is admixed coaxially, has been found to be successful for chromatography microcolumns that only deliver a small stream of liquid (and also for capillary electrophoresis). The supplementary liquid is able to stabilize the spray since pH values and other parameters of the liquid can be adjusted without reference to the values of the parameters in the chromatography column. However, this also reduces the concentration of the analyte.

In order, at least, to keep the larger droplets away from the transfer capillary, not pointing the spray capillary directly towards the entrance of the mass spectrometer but blowing the spray cone past the entrance while maintaining a large angle between the spray capillary and the transfer capillary has been found to be effective (J. A. Apffel et al. U.S. Pat. No. 5,750,988). The distance is selected so that the spray cloud comes to a stop, due to friction in the surrounding gas in the extended axis of the transfer capillary, about three to five centimeters from the capillary's entrance (i.e., stopping in relation to the gas flow). The larger droplets then continue to travel due to inertia and miss the transfer capillary. The ions and the charged droplets are pulled laterally out of the spray cloud towards the transfer capillary, partly dried, captured by the suction funnel in front of the capillary entrance and pulled along by viscous entrainment (gas friction) into the capillary. In this process, the ions can be concentrated in front of the transfer capillary by applying suitable fields and exploiting the ion mobility (e.g. by concentric, semi-spherical shaped grids: E. W. Sheehan et al., US02/0 011 560 AI).

The transfer capillary is usually screened by an apertured diaphragm which is used to guide the hot drying gas and shape the electric field. The flow of drying gas is guided past the entrance of the transfer capillary to the spray cloud. The electric field between the ionization cloud, apertured diaphragm and transfer capillary guides the ions from the spray cloud, through the gas flowing in the opposite direction, to the entrance of the transfer capillary. At the same time, there is often no choice but to accept that the droplets are also pulled into the transfer capillary together with the ions. These droplets are hydrodynamically focused in the transfer capillary and reach the vacuum system. An attempt is then made at repairing the damage in the vacuum system as the ions move on (see for example, A. Mordehai and S. E. Buttrill, U.S. Pat. No. 5,818,041 and WO 97/30 469 A1).

As indicated above, today, other principles which have their merits for other classes of analyte substances are also used for the ionization instead of the electrospray. The spray can therefore produce droplets by pneumatic means alone and without an electric drawing field, in which case, they do not carry a charge. The molecules can then be ionized in the droplets or after the liquid has evaporated by reacting with the primary ions from a corona discharge. This method is called APCI (atmospheric pressure chemical ionization, see, for example, Y. Takada et al., U.S. Pat. No. 5,877,495 and Y. Takada et al., U.S. Pat. No. 6,121,608). However, the molecules can also be ionized by UV radiation with a photon energy of about seven to ten electron volts, as known from ion mobility spectrometry. This is known as APPI (atmospheric pressure photoionization).

Special versions of the electrospray method relate to apparatuses for particularly low flow rates in the spray. By using very fine capillary tips, it is possible to maintain the flow rate at a few tens of nanoliters per minute. These so-called "nanospray" embodiments form droplets which are only about 100 to 200 nanometers in diameter. The spray jet can then be pointed directly into the entrance of the transfer capillary from a distance of about two millimeters. In this case, no charging of surfaces inside the vacuum system takes place. The droplets appear to evaporate fully on their way through the transfer capillary.

With the matrix-assisted laser desorption and ionization at atmospheric pressure method (AP-MALDI), only recently commercially introduced, the ionization cloud is produced by laser light bombardment from a pulsed evaporated sample. The ionization cloud initially only consists of a matrix vapor with few analyte molecules blown into the gas phase. Only a tiny proportion of the molecules, of the order of a hundredth of a percent or less, are ionized. The cloud rapidly mixes with the surrounding gas. Here, the matrix ions does not necessarily have to perform the ionization, as is necessary in a vacuum; other processes have been disclosed which separate the ionization from the desorption (J. Franzen and C. Köster, U.S. Pat. No. 5,663,561). With this method of ionization, in principle, no droplets have to be dried but it is also desirable for a high proportion of the ions, as in the case of the spray method, to be transferred to the vacuum of the mass spectrometer. It is also desirable to ionize more analyte molecules than before.

In principle, any type of mass spectrometer can be used to analyze the ions from the ionization cloud, provided it is possible to make the ionization process sufficiently continuous. Both conventional sector-field spectrometers and quadrupole mass spectrometers can be considered and both types can be used in the form of tandem mass spectrometers to carry out MS/MS analyses.

Time-of-flight mass spectrometers require the orthogonally injected ion beam to be outpulsed into the drift tube. These OTOF mass spectrometers can be used to advantage, because the yield of charged ions to be measured is higher for these than it is for sector-field or quadrupole spectrometers, which act as a filter for a single measured ion mass only.

Storage mass spectrometers such as quadrupole ion-trap or ion-cyclotron resonance instruments are particularly advantageous both for continuous and non-continuous ion generation. These instruments are particularly suitable for scanning daughter or granddaughter ion spectra since they can be used to select and fragment individual ion species in several known ways.

Although the electrospray ion sources in particular have ecperienced many years of development, and there are numerous commercially manufactured ion sources on the market, their development is by no means complete yet. With the previous developments, the emphasis was predominantly on stable operation and not on the highest ion yield. Measured inside the vacuum, a good electrospay is capable of delivering a maximum of 100,000 ions per second. If the spray beam is guided directly at the capillary entrance then, for a brief moment, it is possible to observe an ion beam with a current which is ten to thirty times higher. This drops off within a short time, however, and soon stops altogether. If the capillary entrance is cleaned, the ion beam is raised again, although not to the maximum value, but then drops off just as quickly. Signs of the metal surfaces in the area of the entrance and even in the vacuum area after the transfer capillary becoming charged have been observed. The impact of ions on a clean metal surface only leads to surface charging when there is an extreme predominance of heavy ions. For this reason, either finest drops must play a rôle which, in spite of the hot gas in the counterflow, can reach the metal surface, where they can condense and remain in spite of the high temperature of the surface. This process may also involve polymerization of the liquids due to the impact of reactive ions. Or, surfaces such as those around the entrance of the transfer capillary are covered to a very large extent with analyte ions. The surfaces can only become charged if the coatings consist of at least ten monomolecular layers since the charges can be conducted away from thinner coatings. A coating such as this must contain at least 10 picomol of analyte substance per square millimeter. This value can only be reached, within a period of hours, if the ion guidance is extremely unfavorable and if the majority of the ions are not sucked into the entrance of the transfer capillary.

In any case, the large ion current, which can be achieved for a brief time, indicates that, in principle, very many more ions can reach the vacuum of the mass spectrometer than is the case for the ion spray sources which are in use nowadays. It is, therefore, not the much-feared space charge limit in the transfer capillary which restricts the flow of ions. A method has also been disclosed showing how the ions in the transfer capillary can be hydrodynamically focused in order to avoid ion losses (J. Franzen, U.S. Pat. No. 5,736,740).

SUMMARY OF THE INVENTION

The invention provides devices and methods for the highly efficient delivery of ions to a mass spectrometer, by generating an ionization cloud containing charged particles at atmospheric pressure, by guiding the charged particles through a migration drift tube between the ionization cloud and the entrance opening to the mass spectrometer, and by a counterstream of gas inside the ion migration drift tube.

Thus the basic idea of the invention is to feed the ions from a suitably generated ionization cloud containing charged particles at atmospheric pressure by a well-focusing ion guide in the form of a lengthy drift tube, using the principle of ion mobility, directly into the center of the gas suction funnel in front of the entrance opening to the mass spectrometer, which sucks surrounding gas together with entrained ions into the vacuum system, and, if necessary, to dry droplets stemming from the ionization process reliably in a hot gas counterstream inside the drift tube. The entrance opening may belong to a transfer capillary or to a transfer hole through the wall of the vacuum system. The invention offers a significantly longer guidance path in space and time for drying and desolvating processes, than provided by atmospheric ion sources hitherto. Furthermore, ions above a certain mass-to-charge ratio are guided without severe losses by their ion mobility in a well-focusing electric field, set up and maintained by a potential gradient inside the tube, to the entrance opening of the mass spectrometer, whereas light ions of no analytical interest can leave the trail of heavy ions by diffusion processes and space charge repulsion, not hitting the gas suction funnel at the entrance opening.

The protective or drying gas inside the drift tube provides clean conditions for the migration of charged droplets, solvated ions, and desolvated ions, helps evaporating the solvent, prevents any further reaction of the ions and, serving as a clean transfer gas to the mass spectrometer through the transfer capillary, does not add any contamination to the system. With spraying methods for ionization, the drying gas can be hot in order to promote droplet evaporation. The temperatures of the dry gas are usually up to 300 degrees Celsius, in order to prevent the droplets from freezing and keep them evaporating.

A gas suction funnel is created in front of the entrance of the capillary due to the gas flow in the transfer capillary. A favorable shape of the tip of the transfer capillary maintains laminar flow conditions all along from the suction funnel to the interior of the transfer capillary. The ions, which are guided by ion mobility into the suction funnel in front of the capillary, are swept into the capillary by gas friction. The radius of the part of the suction funnel from which the ions are drawn depends on the gas flow in the capillary and the size of the ions since, because of their larger cross section, heavy ions are more easily entrained with the gas, even against weak electric fields acting in the opposite direction.

With continuous ion generation and continuous ion admittance into the drift tube, mass spectra representing the ion mixture inside the ionization cloud are measured. However, with pulsed ion generation, such as in MALDI processes, or by pulsed ion admittance into the ion mobility drift tube, ions of different ion mobility velocities reach the tip of the transfer capillary at different times. The ion mobility separation can be used to analyse, by the mass spectrometer, the ion mobility spectrum of the ions, in addition to the mass of the ions, or to select ions from preselected parts of the ion mobility spectrum for mass analysis.

DETAILED DESCRIPTION

Figure 1:
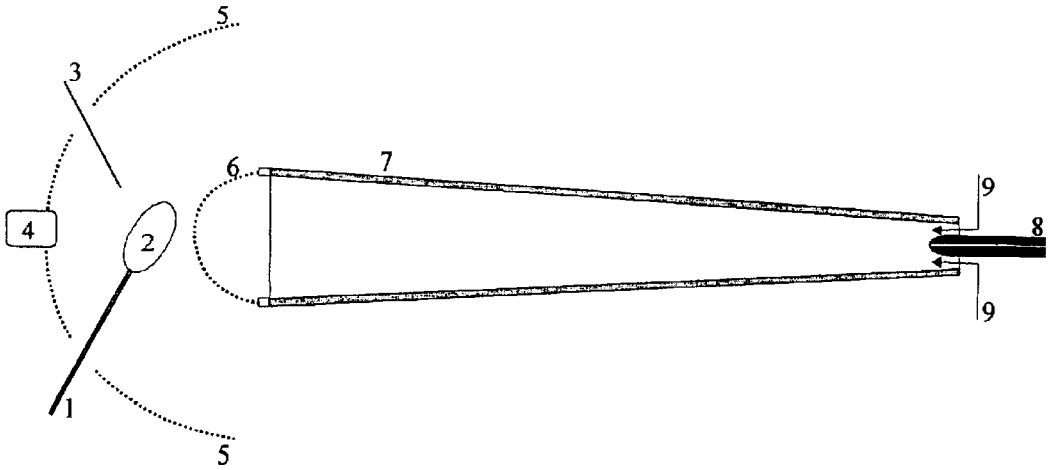
FIG. 1 shows a schematic diagram of an apparatus according to this invention generating the ionization cloud containing charged particles by electro spraying.
Figure 2:
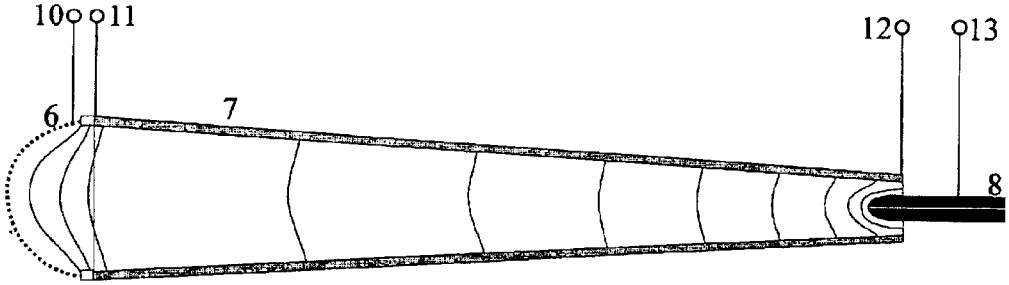
FIG. 2 shows equipotential surfaces inside the drift tube, favorable for guiding the ions to the gas suction funnel in front of the opening of the transfer capillary. The drift tube is made from a resistance material such as a resistance ceramic.
Figure 3:
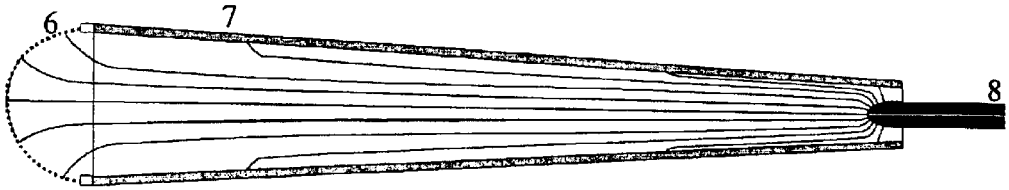
FIG. 3 shows the electric field lines inside the conical drift tube (7) along which the ions and charged particles drift towards the elliptically rounded head of the transfer capillary (8).

A favorable embodiment for the ion guidance arrangement with ion generation by a spray method at atmospheric pressure is shown in FIGS. 1 to 3.

The spray capillary (1) produces a droplet cloud (2) which, in this case, represents the ionization cloud containing charged particles. The charged particles may be generated solely by electrospraying, or by additional means. An optional corona needle (3) is able to provide additional primary ions for chemical ionization of analyte molecules and droplets inside the ionization cloud. A UV lamp (4), which is also optional, can be switched on for photoionization. A voltage can be applied to the grid-shaped electrode (5) in this figure to produce the potential difference necessary for electrospraying at the tip of the spray capillary (1). Charged droplets and ions formed in the ionization cloud (2) in front of the spray capillary (1) are pulled by a weak electric field between the grid electrodes (5) and (6) towards the hemispherical, very transparent grid (6). During this process, hot drying gas (preferably purified nitrogen) flows from the drift tube (7) and dries a good portion of the droplets before they arrive at the grid (6).

The hemispherical grid electrode (6), located opposite the electrode (5), is at a potential which slightly attracts the charged particles. The ions and charged droplets of the desired polarity are therefore drawn from the spray cloud towards this grid (6), penetrate the grid and migrate inside the ion-mobility tube (7) in a focused manner towards the tip of the transfer capillary by weak electric fields. During this process, they remain in the hot drying gas which is traveling in the opposite direction; this gas is admitted into the drift tube (7) around the transfer capillary (8) in direction (9).

The drying gas which is supplied to the drift tube is preheated to temperatures between 120° C. and 300° C. The remaining droplets and the already dry ions arrive at the grid (6) in the center, move through and migrate towards the transfer capillary in the opposite direction to the drying gas in the center of the drift tube. During this process, the remaining droplets are dried and solvated ions are widely desolvated.

As the droplets are dried, a very large number of light ions are created, such as $H_3O^+$ or $H_5O_2^+$. If organic solvents are also present in the spray liquid, ions will be formed from the solvent molecules as well. These light ions will accompany the heavier ions of the analyte substances.

Inside the drift tube, a trail of migrating ions is formed which attempt to follow exactly the field lines shown in FIG. 3. Precise migration along the field lines is only disrupted by two effects: diffusion in the hot gas and mutual coulombic repulsion of the ions (which is also termed space charge repulsion). Both effects are much stronger on light ions than on heavy ions because the lighter ions are much more mobile. Their diffusion rate is higher. The light ions are deflected more quickly than the heavy ions with the same coulombic force. The two effects together result in the light ions collecting in the outer zone of the ion trail, from where they migrate to the transfer capillary more quickly because of their higher mobility.

The transfer capillaries used are usually made of glass or metal with an internal diameter of approximately 500 micrometers and are approximately 150 millimeters long. Glass capillaries are about six millimeters thick and are metallized on the outside at both ends. They have the advantage of being able to transport the ions into the vacuum of the first pump stage of a mass spectrometer, even against an electrical potential of a several kilovolts. Transfer capillaries of this size suck about two liters of gas per minute into the vacuum. It is advantageous for the metallized surface of the input end to be in the form of a removable cap which can easily be replaced. Inside the vacuum system of the mass spectrometer, ions and protective gas are separated by known means. The separated ions are then fed to the mass analyzer, usually by some well-known kinds of RF ion guides.

The gas suction of approximately 30 milliliters of hot drying gas per second produces a gas suction funnel in front of the entrance opening of the transfer capillary in which the flow velocities are already very high. Due to gas friction, the flowing gas sweeps entrained ions into the entrance opening, even when the electric field lines are pointing in another direction. During this process, the heavy ions are entrained more easily than the light ions since the cross section of the heavy ions is greater. For the analyte ions of interest within the mass range of approximately 500 to 5000 atomic mass units, the diameter of the entraining gas suction funnel is about three to four millimeters. Inside the entrance to the transfer capillary, the gas flow speed is about 150 meters per second. In the suction funnel, the gas flow speed is about 1.5 meters per second 2 millimeters from the entrance opening. With an electric field of 10 volts per millimeter, the ion-mobility velocities of the ions are of the order of one meter per second, strongly dependent on the size of the ions. Light ions of higher mobility are more able to follow the electric field lines and will therefore impact on the metallized coating around the entrance of the transfer capillary more easily, become discharged and continue on their way as neutral gas molecules.

However, there is a danger that ions from the margins away from the axis of the suction funnel, which have pronounced radial velocity components during entrainment, will come into contact with the inner surfaces of the capillary entrance, being discharged there, and thus being eliminated from the process. If the entrance opening is surrounded by a sharp edge, turbulent flow will occur in the first few millimters inside the capillary, and ion losses will be observed by ions impinging on the inner surface of the capillary. It is therefore important to try to guide the ions into the zone near the axis of the suction funnel, which means a region about two millimeters in diameter, and to maintain a laminar flow of the gas all along the gas suction funnel well into the capillary.

Figure 4:
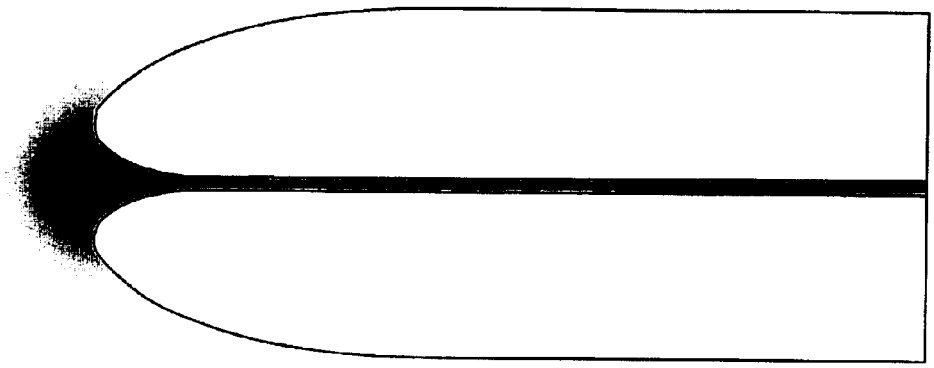
FIG. 4 shows an optimum shape for the tip of the transfer capillary showing the suction funnel. The rounded shape of the entrance provides laminar flow from the suction funnel into the capillary.

According to this invention, the tip of the transfer capillary should have the smallest possible radius around the opening of the capillary in order to keep the field lines together as close as possible to the center of the suction funnel as possible. Because of this, the trail of ions with the heavy ions at the center are guided by the electric field lines precisely into the center of the suction funnel. The heavy ions are for the most part entrained and swept into the opening, thus being transferred into the vacuum of the mass spectrometer. On the other hand, it is advantageous to shape the entrance opening of the transfer capillary in the form of a trumpet-like funnel in order to create a laminar flow all along the way from the gas suction funnel into the capillary. These two requirements are conflicting. A compromise is shown in FIG. 4, where the electric field lines are bundled together to the bowed front edge.

As shown in FIG. 2, the potential inside the drift tube is maintained by voltage conductors (10) at the entry grid for the drift tube, (11) for the start of the tube, (12) for the end of the tube and (13) for the transfer capillary with its metallized surface. Since the cross-sectional surface area becomes smaller towards the transfer capillary, the resistance increases per unit length, thus providing the non-linear potential which gives rise to the curved equipotential surfaces inside, forming focusing field lines. This increasing potential is indicated by the equipotential surfaces getting closer together.

The curved equipotential surfaces in the drift tube have the effect of making the bundle of electric field lines more and more tight inside the drift tube and therefore focusing the trajectories of the ion trail. Curved equipotential surfaces can be produced in the drift tube by setting up an increasing potential gradient in the tube as shown in FIG. 2. Using a conical drift tube made from a resistance material with uniform wall thickness, i.e., an increasing resistance per unit length towards the thin end of the cone, automatically results in such favorable conditions with curved equipotential surfaces and increasingly close electric field lines in the shape of a cone, as shown in FIG. 3. The same applies to a conical drift tube made from insulating material which is coated with a resistance material of uniform thickness.

In FIG. 3, it can be seen that the ions from the middle of the hemispherical entry grid (in the shaded area) are forced to migrate, by the shape of the electric field, into the center of the suction funnel in front of the entrance to the transfer capillary. Here, they are automatically sucked in with the surrounding gas and transferred to the vacuum of the mass spectrometer.

At the same time, a conical or trumpet-like drift tube has another beneficial effect—it produces a higher velocity near to the entrance of the transfer capillary than further away. Large droplets which experience greater friction will remain in the gas flow in the further part of the cone, where the gas flow in the opposite direction is slower, until, by decreasing in size, they are able to overcome the resistance of the faster gas flow in the narrower part of the cone. This stopping behavior of the droplets can be adjusted by the gas flow to admit only ions below a predetermined m/z (mass over charge) to enter the mass spectrometer.

Dissolved analyte molecules can be ionized by the original electrospray method, with or without the support by a spray gas, or by photoionization or chemical ionization of the molecules evaporated in the spray mist, or by using mixed versions of these methods.

Among the supporting methods, APCI (atmospheric pressure chemical ionization) has already been in use for a long time. Primary ions are produced by corona discharge at the tip of a needle at high electrical potential. In this case, ions are first produced from the surrounding gas, so generally nitrogen ions. These immediately react with even the smallest admixtures of water molecules, finally producing $H_3O^+$ and $H_5O_2^+$ ions, which serve as a protonating reagent for ionizing the analyte molecules.

Until now, chemical ionization at atmospheric pressure by primary ions produced by electron impact has not been known for mass spectrometry, although well known from ion mobility spectrometers. Primary ions can be formed from the surrounding gas by using foils with beta-emitting radioactive material, such as $^{60}$Ni, or by means of electrons with energies of several thousand electron volts, generated by X-ray or UV beam with post-acceleration. The primary ions then form protonating secondary ions, as described above, which in turn ionize the analyte ions.

A further method for supporting ionization is photoionization using UV-lamps. However, photoionization is not limited to being used directly used on analyte molecules, but can also be used indirectly via chemical ionization. For example, if a mediator component (such as benzene, toluene or xylene, which can be very easily ionized by photoionization because of their chromophores, and are also easy to use for protonating ionization) is admixed to the spray gas, these mediator ions can be used to chemically ionize analyte molecules.

The matrix-assisted laser desorption and ionization at atmospheric pressure method (API MALDI) consists in converting solid sample preparations on a sample support, which carries the analyte molecules embedded in a matrix, into the vapor state by pulsed laser shots, thus ionizing a small proportion of the analyte molecules. Each pulsed laser shot produces an ionization cloud. For the ionization, it is advantageous to cause the ionization cloud to move slowly away from the sample support by introducing a guide gas radially under a shield. In this way, additional analyte molecules can be ionized by matrix ions. Although MALDI operating at atmospheric pressure makes it possible to ionize more analyte molecules than with the same method in a vacuum, nevertheless the analyte ion yield is not particularly high in comparison with the number of analyte molecules which are available. For this reason, it is advantageous also in this case to increase the yield of analyte ions by chemical ionization or photoionization.

Figure 5:
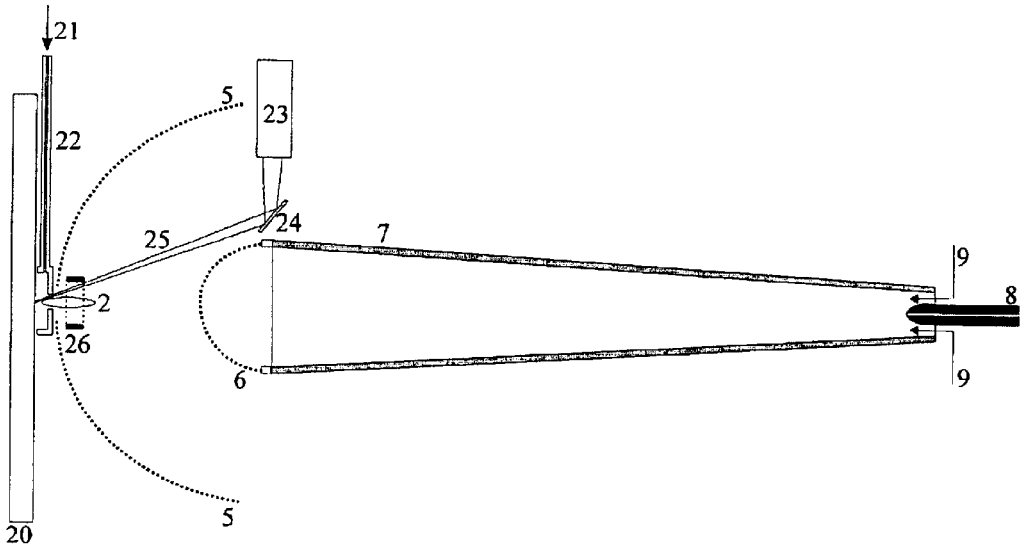
FIG. 5 shows an apparatus for matrix-assisted laser desorption and ionization at atmospheric pressure (API-MALDI) with the ion mobility drift tube according to this invention.

In FIG. 5, an API MALDI ion source is shown in connection to this invention. The sample preparations are located on the sample support plate (20) which is mounted so that it can be moved in order to transport all the sample preparations into the focus of the laser beam (25) formed by the laser (23) and the reflector (24). The ionization cloud (2) formed by the laser bombardment is moved through a shield (22) with a feed for a guide gas (21) in the direction towards the grid (6). During this process, the cloud passes an annulus which is made from $^{60}$Ni film. This generates electrons which also ionize the molecules in the cloud. A chain of ionization processes thus chemically ionizes the analyte molecules which are in a more favorable state energetically to be ionized, as already known for ion-mobility spectrometers. As well as guide gas (usually nitrogen), a mediator gas which assists in the ionization can also be supplied through the guide shield (22). Instead of electron impact ionization, photoionization can be used by means of a UV lamp (not shown). In this case also, the mediator assists in the chemical ionization.

For example, the cloud produced by laser bombardment can be guided though a foil ring with a material emitting beta radiation, as shown in FIG. 5. Or, the cloud can be radiated with a UV lamp. Special mediator substances such as benzene, toluene or xylene, which can be initially ionized to produce a high yield and to make protonation of the analyte molecules easier, can be added to the cloud by admixing it to the guide gas. The guide gas and the additional mediator substances can be supplied radially through a covering annular diaphragm, as shown in FIG. 5, for example. The laser beam brings about desorption via the central opening of the annular diaphragm, through which the resulting cloud escapes.

The promising method of chemical ionization using a mediator substance is not yet in use. The method can also be used with chemical ionization by electron impact.

The drift tube can be assembled from a number of coaxially arranged annular electrodes with insulating distance pieces made from ceramic, as is the usual practice with ion-mobility spectrometers. However, the drift tube can also be made from resistance material, such as a resistance ceramic, in order to set up continuous potential gradients along its length. A film of resistance material applied to the surface can also be used. If a potential gradient of approximately 100 volts is to be produced in the tube, then the total resistance must be at least several kilohms in order to avoid heating the tube to too high a temperature. Higher potential gradients can also be used. The drift tube is able to tolerate several watts of heating power.

The drift tube for guiding the ions does not have to be straight. With a little skill, it can also be folded in a meander shape or wound to form a helix for guiding the electrical lines of force. In particular, several drift tubes can be used one after the other. With appropriately shaped electric fields, the ions can be guided from one piece of tube into the next relatively free of any electron losses while being focused at the same time. In this case, a series of pieces of the tube can be connected at an angle to each other.

The drift tube should be provided with a convex, very transparent grid at the entrance near to the spray-ion cloud in order to attract the ions and charged droplets and allow them to migrate immediately towards the axis of the drift tube. One favorable form is a ball-shaped cap such as a hemisphere, as shown in FIGS. 1 and 5. The grid (6) is at a voltage which slightly attracts the ions and charged droplets from the ionization cloud. The spray capillary can be arranged so that extremely large droplets travel past this convex grid due to their inertia and do not enter the drift tube. The spray jet can also be directed towards the grid if the formation of larger droplets can be prevented. Directing the spray towards this grid (6) is the preferred spray direction, particularly for nanospray needles.

It is possible to make the ion migration extremely focused by using two or more conical drift tubes one after the other with a hemispherically shaped entrance grid in each case. This form of focusing is only limited by the diffusion and space charge repulsion.

The space charge repulsion in the migration path has the effect of driving the lighter ions, such as the $H^+$ ions and $H_3O^+$ ions of which there is an excess, outwards since they are more mobile than the heavy ions. Whereas the heavy ions are primarily drawn into the transfer capillary, the light ions primarily hit the outer areas of the transfer capillary around the entrance. This effect is very favorable; these ions are not wanted in the mass spectrometer, and these impinging ions do not give rise to surface charging since their discharge produces volatile gases.

If particles of different polarity are admixed to the drying gas in the outer zone, then the light ions can also be partially neutralized. For the analysis of positive ions, electrons which primarily neutralize the lighter ions can be admixed to the drying gas. These electrons can, for example, be generated as photoelectrons by bombarding the metallic region of the head of the transfer capillary around the entrance with a UV laser etc.

However, the lighter ions can also be sucked through special annular electrodes in front of the entrance to the transfer capillary. Removing most of the light ions prevents the capacity of the transfer capillary from being saturated too quickly because of the space charge in the gas flow being too high.

If no droplets are formed as outliers of a particular size during spraying, then the spray beam can be pointed directly at the hemispherical grid at the entrance of the drift tube. The smaller the cross section of the ionization cloud from which the ions are drawn, the smaller the cross section of the ion trail in front of the suction funnel. In any case, the capillaries for the nanospray can be arranged so that they spray precisely in line with the axis of the drift tube onto the entrance of the drift tube. It is also advisable to direct the movement of the API MALDI ionization cloud towards this grid.

The ion migration inside the ion mobility tube can also be used to measure an ion mobility spectrum of the ions or to select ions of preselected mobility values for mass analysis. With pulsed ion generation such as in MALDI laser shots, or with pulsed admittance of ions into the tube by grid (6), ion mobility spectra may be measured, yielding full mass spectra for each mobility value. The grid (6) may be formed by parallel wires with DC voltages alternating from wire to wire during the time where access is denied, switching to a uniform DC voltage at all wires allowing access. There are different types of mass spectrometers to measure the two-dimensional mobility/mass spectra, for instance, very fast time-of-flight mass sepctrometers with orthogonal ion injection, or different types of ion trap mass spectrometers.

What is claimed is:

1. Apparatus for the delivery of ions generated at atmospheric pressure to a mass spectrometer having a vacuum system with an entrance opening, the apparatus comprising:

(a) an ion generator that generates an ionization cloud containing ions at atmospheric pressure, (b) an ion migration drift tube between the ionization generator and the entrance opening, the drift tube receiving the ionization cloud, (c) a field-generating apparatus that produces a DC potential gradient with curved equipotential surfaces inside the ion migration drift tube that draws ions of the ionization cloud toward the entrance opening, and (d) a gas port through which a gas may be introduced to the ion migration drift tube in a direction opposite to a direction of ion travel.

2. Apparatus according to claim 1 wherein the ion generator comprises an electrospray apparatus with a spray capillary that sprays a solution containing analyte molecules.

3. Apparatus according to claim 2 wherein a pneumatic gas device supports the spraying.

4. Apparatus according to claim 2 further comprising an arrangement of electrodes and power supplies that produce a strong electric field in front of the spray capillary.

5. Apparatus according to claim 1 wherein the ion generator comprises a pulse laser that forms an ionization cloud by laser desorption.

6. Apparatus according to claim 1 further comprising a ionization gas input path through which gaseous substances may be admixed to the ionization cloud prior to its entry into the drift tube.

7. Apparatus according to claim 1 further comprising a needle for producing corona discharge in the vicinity of the ionization cloud.

8. Apparatus according to claim 1 further comprising a UV lamp for photoionization in the vicinity of the ionization cloud.

9. Apparatus according to claim 1 further comprising an electron source in the vicinity of the ionization cloud.

10. Apparatus according to claim 9 wherein the electron source contains a foil emitting beta radiation.

11. Apparatus according to claim 1 wherein the gas port introduces gas into the drift tube near the entrance opening of the mass spectrometer.

12. Apparatus according to claim 11 lithe gas introduced through the gas port is heated before introduction into the drift tube.

13. Apparatus according to claim 1 wherein the the ion migration drift tube comprises a plurality of electrodes that produce the potential gradient in the drift tube.

14. Apparatus according to claim 1 wherein the ion migration drift tube comprises a resistance material.

15. Apparatus according to claim 1 wherein the ion migration drift tube has a conical or trumpet shape with a wider opening being directed towards the ion generator.

16. Apparatus according to claim 1 wherein an opening of the ion migration drift tube facing the ion generator is covered by a grid which bulges outwards.

17. Apparatus according to claim 1 wherein the entrance opening is part of a transfer capillary, and wherein an outer shape of a tip of the transfer capillary is convex.

18. Apparatus according to claim 1 wherein the entrance opening approximates a funnel shape.

19. Apparatus according to claim 1 further comprising a ionization gas input path through which a hot drying gas and charged particles may be admixed to the ionization cloud, the particles having a charge that allows them to neutralize ions in the spray chamber or later in the drift tube.

20. Apparatus according to claim 1 wherein the ion migration drift tube has a curved shape.

21. Apparatus according to claim 1 wherein the ion migration drift tube is a first drift tube, and wherein the apparatus further comprises additional drift tubes such that the ion migration drift tubes are connected to one another.

22. Method for feeding ions at atmospheric pressure to a mass spectrometer, the method comprising the following steps:

(a) forming an ionization cloud containing charged particles at atmospheric pressure, (b) guiding the charged particles by their ion mobility through an ion migration drift tube and focusing them into an entrance opening of the mass spectrometer with a DC potential gradient having curved equipotential surfaces, and (C) blowing gas into the ion migration drift tube from adjacent the entrance opening.

23. Method according to claim 22 wherein the ionization cloud is created by spraying a solution containing dissolved analyte from a spray capillary.

24. Method according to claim 23 wherein the spraying is pneumatically supported by a spray gas.

25. Method according to claim 23 further comprising drawing charged droplets into the ionization cloud using a strong electric field in front of the spray capillary.

26. Method according to claim 22 wherein the ionization cloud is created by bombardment of a sample with light from a pulsed laser.

27. Method according to claim 22 further comprising admixing other gaseous substances to the ionization cloud.

28. Method according to claim 22 further comprising providing a corona discharge that produces primary ions in the vicinity of the ionization cloud which lead to chemical ionization of the analyte molecules via a chain of ion-molecule reactions.

29. Method according to claim 22 further comprising using a UV lamp for ionizing substances in the ionization cloud.

30. Method according to claim 22 further comprising using an electron source for ionizing substances in the ionization cloud.

31. Method according to claim 30 wherein a foil emitting beta radiation is used as the electron source.

32. Method according to claim 22 wherein the gas is introduced into the drift tube in a direction opposite the travel direction of the charged particles.

33. Method according to claim 32 wherein the gas is heated before being introduced into the drift tube.

34. Method according to claim 22 further comprising admixing charged particles to the gas, whereby the particles neutralize some of the ions in the drift tube.

35. Method according to claim 34 further comprising irradiating an area around the entrance opening with UV radiation to release photoelectrons that neutralize ions.

* * * * *